US005946826A

United States Patent [19]

Merle et al.

[11] Patent Number: 5,946,826

[45] Date of Patent: Sep. 7, 1999

[54] BOOT HAVING CLOSURE FLAPS WITH AN INSTEP TONGUE

[75] Inventors: Christian Merle, Vieugy, France; Giuseppe Garbujo, Montebelluna, Italy

[73] Assignee: Salomon S. A., Metz-Tessy, France

[21] Appl. No.: 08/942,543

[22] Filed: Oct. 1, 1997

[30] Foreign Application Priority Data

Oct. 2, 1996 [FR] France ..... 96 12279

[51] Int. Cl.[6] ..... A43B 5/04

[52] U.S. Cl. ..... 36/50.5; 36/54

[58] Field of Search ..... 36/50.5, 117.1, 36/54

[56] References Cited

U.S. PATENT DOCUMENTS

| | | | |
|---|---|---|---|
| 4,974,346 | 12/1990 | Marega et al. | 36/117 |
| 5,005,303 | 4/1991 | Bonaventure et al. | 36/120 |
| 5,259,127 | 11/1993 | Pallatin | 36/117 |
| 5,381,611 | 1/1995 | Tonel et al. . | |
| 5,410,822 | 5/1995 | Vaccari . | |
| 5,826,354 | 10/1998 | Garbujo | 36/117.1 |

FOREIGN PATENT DOCUMENTS

| | | |
|---|---|---|
| 0353532 | 2/1990 | European Pat. Off. . |
| 0659358 | 6/1995 | European Pat. Off. . |
| 2693085 | 1/1994 | France . |
| 271363 | 1/1951 | Switzerland . |

*Primary Examiner*—Ted Kavanaugh
*Attorney, Agent, or Firm*—Greenblum & Bernstein, P.L.C.

[57] ABSTRACT

A sports boot including an upper and a shell base having a rear portion that encircles the ankle and a frontal portion closed by transverse flaps that surround the front foot area. The flaps are equipped with instep tongues that extend in the longitudinal direction of the boot. These tongues are each connected by a sliding connecting element to the contiguous flank of the rear portion of shell base. The connecting element guarantees the constant maintenance of the tongue with respect to the contiguous flank while still allowing substantial freedom of clearance from the instep zone.

20 Claims, 3 Drawing Sheets

Fig: 1
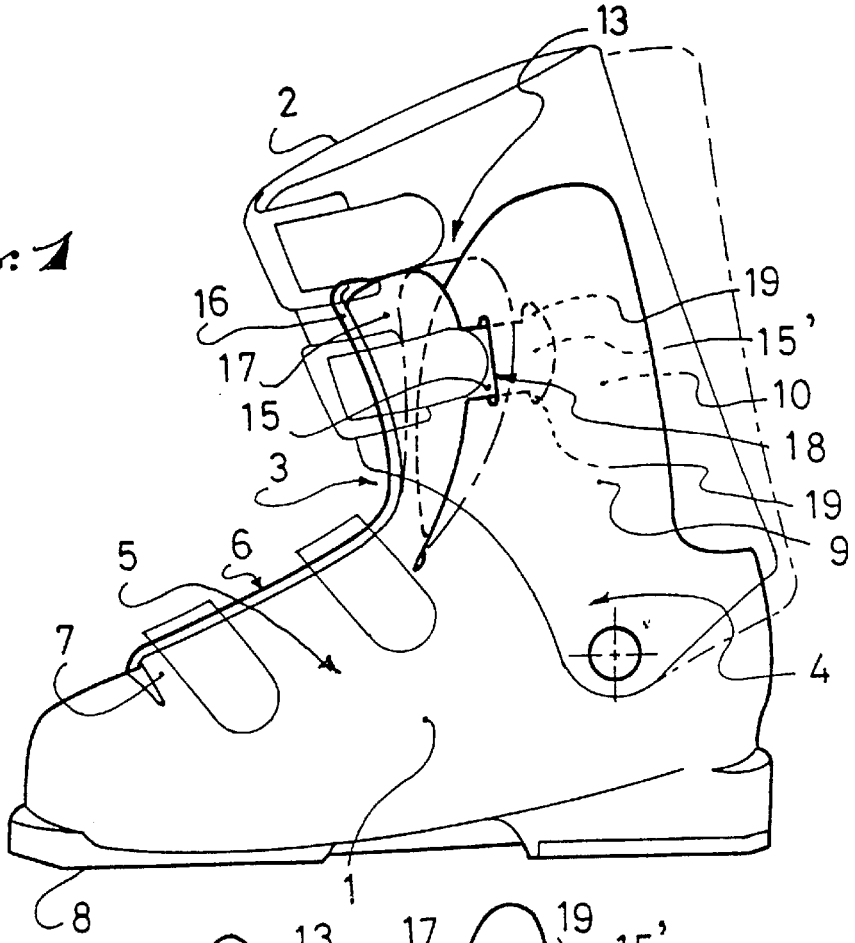
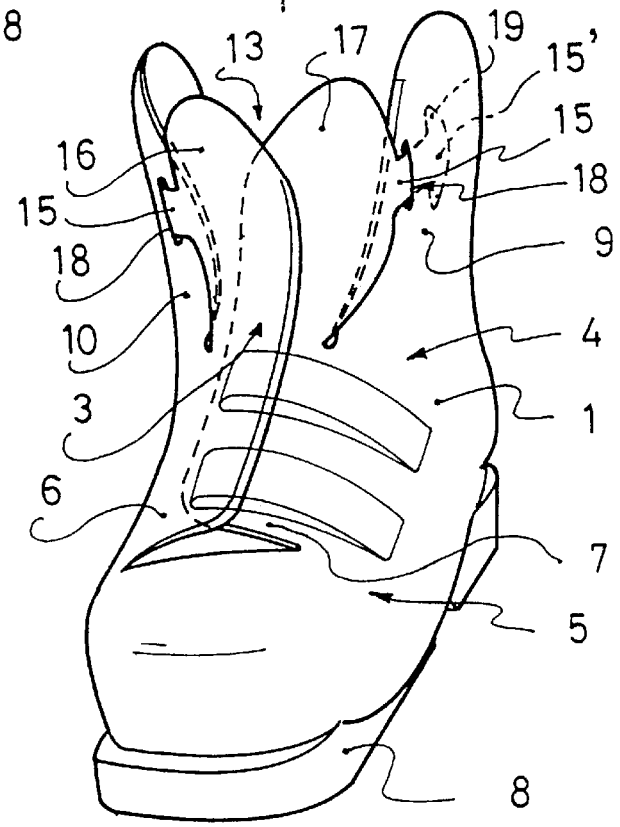
Fig: 2

BOOT HAVING CLOSURE FLAPS WITH AN INSTEP TONGUE

BACKGROUND OF THE INVENTION

1. Field of the Invention

The present invention is related to a sports boot that closes on top of the foot by means of transverse flaps that overlap partially, and is especially related to a boot, one of whose transverse flaps at least extends up to the top of the instep zone via a tongue oriented in the lengthwise direction of the boot.

2. Description of Background and Relevant Information

Sports boots of the aforementioned type are known, for example, by the boot styles "Formula 77", "Pro 77" and "Elite 77", marketed in 1977 under the brand name Tecnica, as well as by the disclosure of U.S. Pat. No. 4,974,346 and the published patent application EP 659 358. These boots comprise an upper that is used to retain the lower part of the leg, and a shell base for the retention of the foot. To this end, the shell base has a rear portion that encircles the ankle and that is shaped like an open tube that corresponds with the instep, and a front, split portion that surrounds the front of the foot and that is closed by transverse flaps. In addition, at least one of such flaps become extended into the instep zone by a relatively flexible tongue that extends in the lengthwise direction of the boot and is independent of the contiguous flank extending from the rear portion of the shell base that encircles the ankle. In a traditional manner, the upper of the boot is advantageously assembled so as to overlap the rear portion of the shell base that encircles the ankle, thus guaranteeing a certain imperviousness, and tightening and closure devices are associated to the upper and to the shell base.

By these various arrangements, the closure and tightening of these boots can be done differently between the upper and the shell base. Indeed, the tongue constitutes a junction element that is automatically adapted therebetween in the instep zone and thereabove, by virtue of its flexibility and its independence with respect to the contiguous flank of the rear portion of the shell base. Consequently, the tongue retains a certain flexibility in the area of the instep zone, notably to allow the bending of the upper when the boot is in the closed position. It also facilitates the passage of the foot when the boot is in the position for putting on and removing the boot since it encourages the upper to open like a tulip in the instep zone under the pressure exerted by the foot.

However, these boots equipped with instep tongues have disadvantages related to the lateral retention of the tongue in a constant overlapping position with respect to the contiguous flank of the rear portion of the shell base. Indeed, after a certain amount of use, the tongue tends to get separated naturally in the instep zone and, due to this fact, is capable of becoming wrongly positioned after the boot has been put on, and during the closure of the upper, and this then requires manual intervention.

This type of disadvantage is especially common in those cases where the tongue is simply separated by a slit or a vertical scallop from the contiguous flank of the rear portion of the shell base, as in the example of the boot disclosed by the patent application EP 659 358. In this example, the tongue is also devoid of any predetermined positioning direction since it does not even partially cover the flank of the shell base. Consequently, there is nothing to stop it from sliding above or beneath the contiguous flank of the shell base during the closure of the upper on the lower part of the leg, and thus from substantially modifying the way in which the wearer's ankle is enveloped, thereby adversely impacting comfort.

In the example of the boot according to U.S. Pat. No. 4,974,346, this disadvantage is avoided by virtue of providing other transverse flaps that originate from the contiguous flanks of the rear portion of the shell base that surrounds the ankle, and extend into the upper zone of the instep while being separated from the lower flaps via a transverse slit. More specifically, these upper flaps are positioned to overlap the instep tongues borne by the lower flaps, and they extend the inner wall of the contiguous flanks of the shell base up to the vicinity of the instep zone in a continuous manner. The result of this arrangement is that the tongues cannot become separated naturally from the instep zone and that their positioning with respect to the contiguous flanks of the shell base is almost immovable. However, the superposition of the tongues with the upper flaps coming from the contiguous flanks of the shell base has other disadvantages. As a matter of fact, in the overlapping area, it constitutes a stratified structure whose stiffness varies in accordance with the tension exerted by the tightening-closure devices of the upper, and this directly modifies the bending conditions of the upper with respect to the shell base. As such, the flexibility of the boot is not maintained in the instep zone. In addition, obtaining upper flaps in the rear portion of the shell base that encircles the ankle hinders the separation of the tongues, and thus the tulip-like opening of the upper in the instep zone during the putting on and removal of the boot. Finally, adding instep tongues, in the slit, on the lower flaps requires an assembly operation that adversely impacts manufacturing costs.

In the example of the boot-styles "Formula 77", "Pro 77" and "Elite 77", marketed in 1977 under the brand name Tecnica, the problem of keeping the instep tongue in a constant overlapping position is partially resolved by virtue of the oversizings of the tongue and of the contiguous flanks of the shell base that extend towards the front up to the vicinity of the instep zone.

More specifically, the tongue of the flap from which it originates is of such a size that it covers the two frontal edges of the flanks of the shell base in the instep zone, and it becomes inserted laterally on either side of the zone, up to a pint beneath the flaps of the upper of the boot. Due to these arrangements, the tongue is always placed on the outside of the contiguous flanks of the shell base but there is no guarantee that it can be maintained beneath the flaps of the upper. As a matter of fact, the action of putting on and removal of the boot requires the disengagement of the tongue from beneath the flaps of the upper, and this then puts it naturally into a position of covering these flaps. The solution implemented in these boots thus appears to be inadequate since it does not guarantee the constant maintenance of the tongue in a preferred overlapping position. Also, due to the over-sizing of the tongue and of the contiguous flanks of the shell base up to the vicinity of the instep zone, the passage of the foot becomes more difficult during the putting on and removal of the boot.

SUMMARY OF THE INVENTION

It is an object of the instant invention to overcome the various disadvantages mentioned above in a simple and efficient manner, without adversely affecting manufacturing costs, and by retaining a substantial degree of clearance for the instep tongue in order to facilitate the putting and removal of the boot, as well as by retaining the overall flexibility of the boot in the instep zone, and this is done whilst guaranteeing a constant maintenance of the instep tongue with respect to the contiguous flank of the rear portion of the shell base that encircles the ankle, or in other words, while guaranteeing the conditions of constant enveloping, imperviousness and comfort.

According to the invention, the sports boot is constituted of an upper and a shell base having a rear portion that encircles the ankle up to the instep zone, and a front, slit portion that surrounds the front foot and that is closed by transverse flaps, at least one of such flaps extending into the instep zone via a tongue that extends in the lengthwise direction of the boot, independently of the contiguous flank coming from the rear portion of the shell base. The tongue of the boot is equipped with a sliding connection, connecting the tongue laterally to the contiguous flank coming from the rear portion of the shell base. This connection is intended to obtain the permanent coupling of the tongue with the contiguous flank of the shell base, allowing a predetermined clearance amplitude, between an initial assembly position and an extreme position of separation from the instep zone. This extreme position is fixed during construction according to the disengagement that one wants to obtain in the instep zone in order to ensure passage of the foot during the putting and removal of the boot.

According to a first embodiment, the sliding connection is constituted by a tab, lateral to the tongue, whose free end is freely engageable in a cut-out provided in the contiguous flank extending from the rear portion of the shell base. The cut-out obtained in the flank contiguous to the tongue thus acts as a passage for the tab thereof whilst keeping it in a constant position, and at the same time allowing it to slide freely relative to the flank. The tab lateral to the tongue is obtained with a predetermined length that is in correlation with the clearance amplitude required for the tongue in order to avoid its free end from escaping accidentally from the cut-out when the tongue is at maximum separation from the instep zone. In fact, its free end remains engaged in the cut-out of the flank contiguous to the tongue.

Advantageously to this end, the lateral tab comprises at least one gripping projection at its free end. This gripping projection is designed to be retractable, or capable of being retracted in the direction of its introduction into the cut-out of the flank that is contiguous to the tongue, and constitutes a retention abutment in the direction of its extraction from the cut-out. It is obvious from this embodiment that the gripping projection is thus sufficiently spaced from the attachment zone of the connecting tab on the tongue in order to allow the desired clearance for the tongue in the instep zone.

According to a second embodiment, the sliding connection is constituted of an oblong slot obtained in the flank contiguous to the tongue, and an element for connecting the tongue with the flank, the element sliding freely in the oblong slot. The latter is oriented in a direction that corresponds approximately to the path described by the connecting element borne by the tongue, and its length is determined in correlation with the clearance amplitude that one wishes to provide to the tongue. As in the previous embodiment, this type of sliding connection places the tongue in a given and constant position with respect to the contiguous flank extending from the shell base. It is understood, as per the design of the enveloping surface of the flanks of shell base around the ankle that the tongue can be overlapping with the contiguous flank from any side, i.e., either from the outside, or from the inside. Also, the tongue can be designed to have a width such that it remains overlapping with the contiguous flank of the shell base when it is in the extreme separation position with respect to the instep zone, and this improves the imperviousness of the boot in this area.

BRIEF DESCRIPTION OF THE DRAWINGS

The invention will be better understood from the description that follows with reference to the annexed schematic drawings, showing as examples, some preferred embodiments wherein:

FIG. 1 is a lateral view of a sports boot, such as a ski boot, whose shell base flaps are equipped with an instep tongue provided with a connecting means as per a first embodiment;

FIG. 2 is a perspective view of the shell base of FIG. 1 that illustrates the reciprocal position of the instep tongues and their relative positions with respect to the flanks of the shell base;

DETAILED DESCRIPTION OF THE PREFERRED EMBODIMENTS

Figure 3:
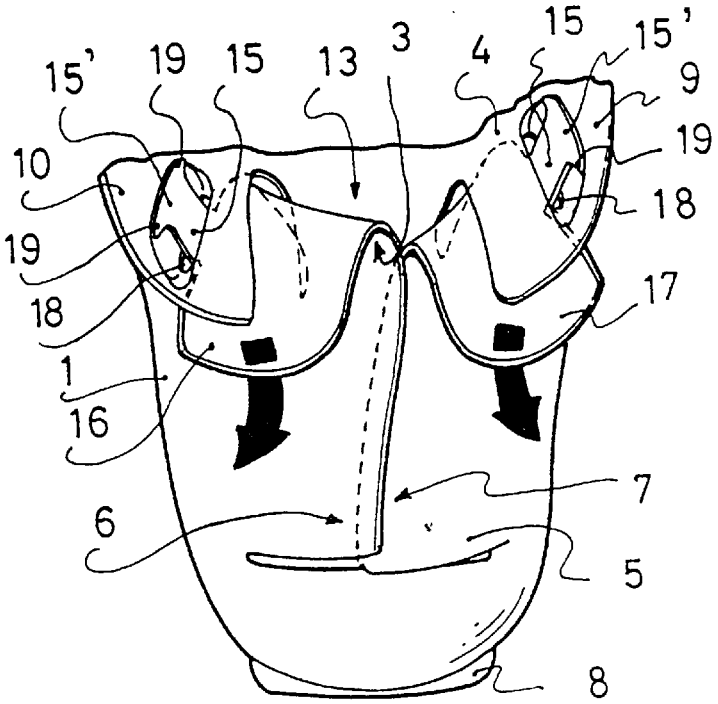
FIG. 3 is a top view of the shell base of the boot of FIG. 1 showing the position of the free end of the connecting means of the tongues with respect to the inside of the boot.

FIG. 1 schematically illustrates a ski boot constituted of a shell base 1, equipped with a sole 8 and an upper portion 2, the upper portion 2 having tightening elements thereon, as seen in FIG. 1, the upper portion being represented in dotted and dashed lines in order to further highlight the specific structure of the shell base 1 in its zone corresponding to the instep 3 zone. In this type of boot, the shell base 1 has a rear portion 4 that encircles the ankle up to the vicinity of the instep 3 zone, and a frontal portion 5, split longitudinally, that encircles the front of the foot. The latter is closed by transverse flaps 6, 7, as can be seen clearly from the drawings of FIGS. 2 and 3, whereas the rear portion 4 has the shape of a tube, comprising, in the instep zone 3, an indent 13 ending upwardly, that demarcates, laterally, the flanks 9 and 10 of the shell base 1 at the level of the ankle.

According to one characteristic, each of the transverse flaps 6, 7 is extended, respectively, in the instep zone 3 via a tongue 16, 17, that extends in the lengthwise direction of the boot and independently of the contiguous flank 9, 10 extending from the rear portion 4 of the shell base 1. Thus, each tongue is separated from an associated flank by means of a longitudinally extending slit. Each tongue 16, 17 is thus free to move in the lengthwise direction of the boot from its attachment zone on the corresponding flap 6, 7. As can be seen in FIG. 2, the flaps 6, 7 are in an overlapping relationship. Further, tongue 16 has a continuous common longitudinal edge with flap 6 and tongue 17 has a continuous common longitudinal edge with flap 7, these edges extending through the entire lengths of the flaps and tongues, i.e., from a front end of the flaps, through the instep zone 3, to an area above the instep zone. In order to guarantee the constant positioning of the tongues 16, 17, whilst retaining their freedom of clearance with respect to the contiguous flanks 9 and 10 of the shell base 1, a sliding connection 15 laterally connects each tongue 16, 17 to the corresponding flanks 9, 10, i.e., the flank on the same side, or common side, as a respective tongue.

In this embodiment, each of the connection 15 is constituted by a tab that is lateral to the tongue 16, 17, whose free end 15' is freely engaged in an oblong cut-out 18 obtained in the contiguous flanks 9 and 10 of the shell base 1. This tab 15, having an elongate shape, is also sized in such a way that its free end 15' cannot escape from the cut-out 18 when the tongue 16, 17 is brought into a predetermined extreme separation position from the instep zone 3.

Advantageously, a gripping projection 19, even two projections 19 are provided on the free end 15' of the connecting tab 15 to serve as retention abutments to the latter when it is pulled in the direction of its extraction therefrom. It is understood that the connecting tab 15 is thus equipped with a certain flexibility allowing the removal of the projections 19 via elastic deformation when its free end 15' is introduced in the corresponding oblong cut-out 18.

Preferably, the end 15' of the connecting tab 15 is engaged in the opening 18, from the outside towards the inside of the shell base 1. In this way, the tongue 16, 17 is automatically placed on the outside of the contiguous flank 9, 10 of the shell base 1, and kept in this position during its entire possible predetermined clearance, between its initial assembly position to its extreme separation position from the instep zone 3.

According to an embodiment detail, the tongues 16, 17 each have a lateral widening on the side directed towards the contiguous flank 9, 10 of shell base 1, ensuring a permanent overlapping with the latter, from their initial assembly position, represented in dashed lines in FIG. 1, to their separation position from the instep zone 3.

In this type of construction, the permanent overlapping of the tongues 16, 17 with the contiguous flanks 9, 10 of shell base 1 makes the boot more impervious.

Figure 4:
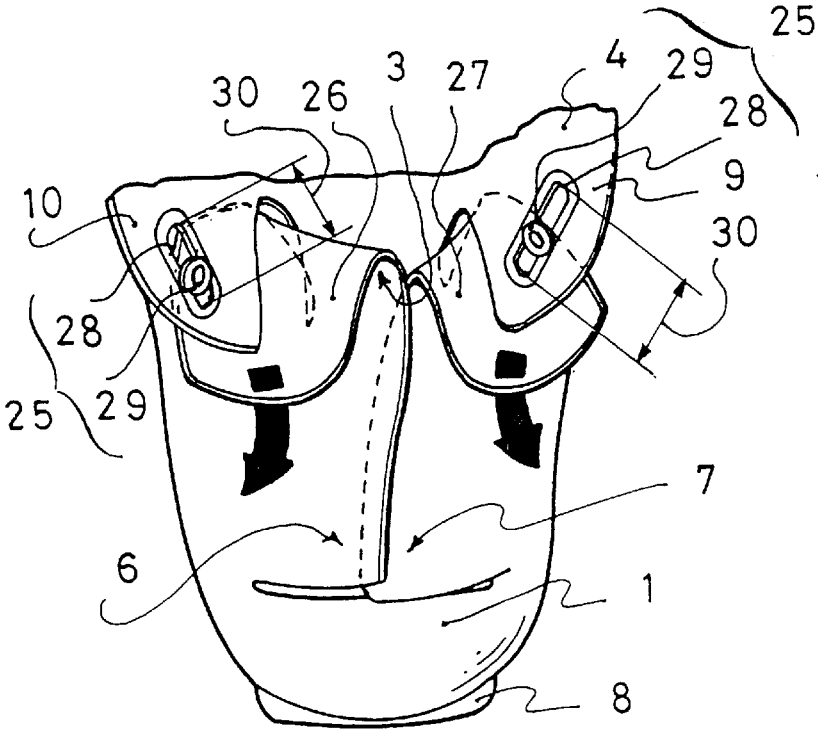
FIG. 4 is a top view of a shell base of a boot of the same type as in FIG. 1 showing the implementation of the connecting means of the tongues as per a second embodiment.

According to a second embodiment represented in FIG. 4, the sliding connection 25 by each tongue 26, 27 is constituted of an elongated or oblong slot 28 obtained in the contiguous flank 9, 10, at each tongue 26, 27, and a connecting element 29 for the tongue 26, 27 with the flank 9, 10 that slides freely in the oblong slot 28.

As was the case previously, the sliding connection 25 is intended to obtain a permanent coupling of the tongue 26, 27 with the contiguous flank 9, 10 of the shell base 1 between its initial assembly position and its extreme separation position from the instep zone 3. For this, the length 30 of the oblong slot 28 is determined in correlation with the maximum clearance amplitude desired for the tongue 26, 27. As can be seen in FIG. 4, the slot 28 is closed, i.e., it has opposite ends that define the length 30.

Figure 5:
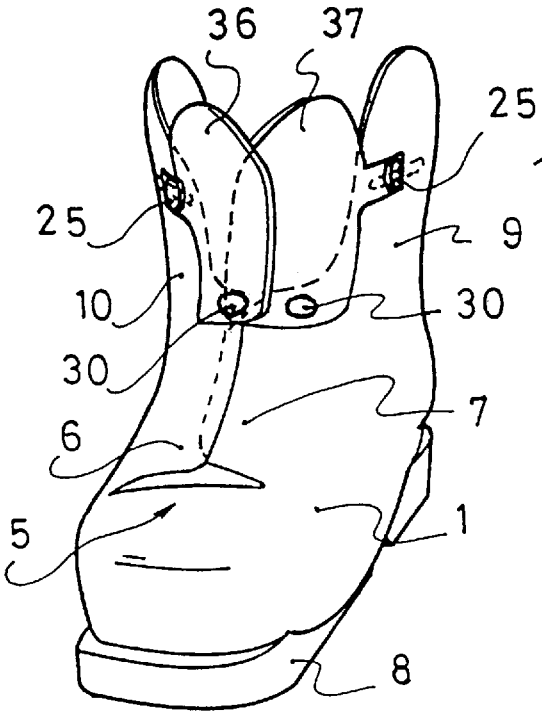
FIGS. 5, 6 and 7 illustrate, only as examples, various embodiments of the instep tongue equipped with a sliding connecting means.

Both the preceding embodiments with reference to FIGS. 1 and 4 show, as examples, a shell base 1 whose tongues 16, 17, 26, 27 are obtained in one piece, i.e., unitary, with the transverse flaps 6, 7. However, it is obvious, as illustrated in FIG. 5, that the tongues 36, 37 can also be constituted of relatively flexible elements that are designed to be independent from the transverse flaps 6, 7. In this case, the elements forming the tongues 36, 37 are attached and affixed on the latter by any known means 30, such as adhesion, welding, rivets etc.

Figure 6:
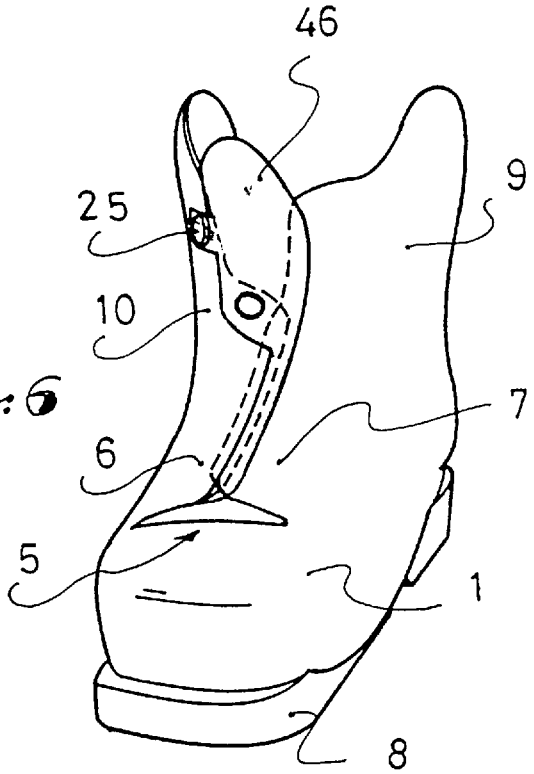
Figure 7:
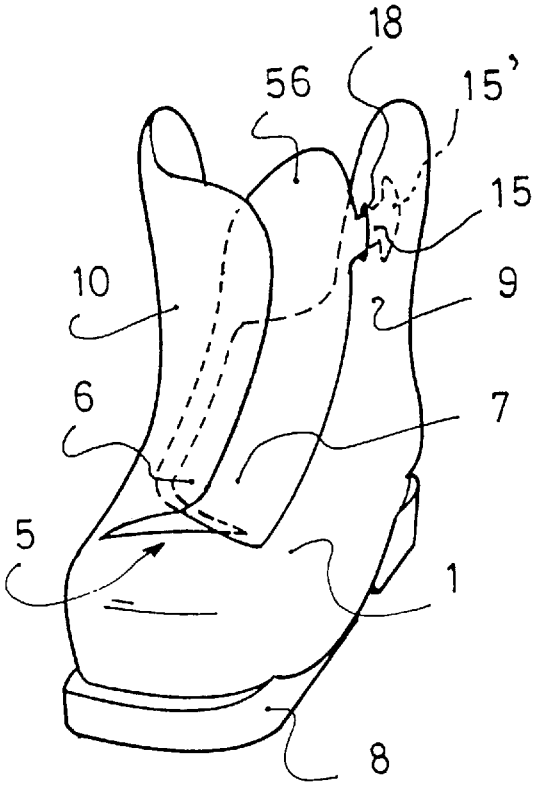

According to other possible embodiments represented in FIGS. 6 and 7, only one of the flaps 6 or 7 can be equipped with an instep tongue 46, 56. This tongue 46 can also be affixed to the outer transverse flap 6, as in FIG. 6, or to the inner transverse flap 7, as in FIG. 7 for the tongue 56.

In addition, the tongues that are constituted of elements that are attached on the flaps 6, 7 can be obtained in a variety of shapes and sizes, without leaving the scope of the invention. Thus, for example, the instep tongue 56 can almost entirely cover the transverse flap 7 on which it is attached and possibly be used as a junction element between the flaps 6 and 7.

Furthermore, the tongues 16, 17, 26, 27, 36, 37, 46, 56 can be designed in such a way that they are assembled to overlap under the contiguous flanks 9 or 10, i.e., from the inside of shell base 1 and not from the outside, as illustrated in the previous drawings.

Finally, a sliding connection other than those represented by 15 and 25 that have been described hereinabove can be implemented on the tongues 16, 17, 26, 27, 36, 37, 46, 56 without leaving the scope of the invention. It is also understood that the tongues can be obtained in various shapes and comprise extensions that have, or do not have, the functional characteristics of imperviousness, protection, reinforcement, etc.

The instant application is based upon the French priority patent application No. 96.12279 filed on Oct. 2, 1996, the disclosure of which is hereby expressly incorporated by reference thereto, and the priority of which is hereby claimed under 35 USC 119.

What is claimed is:

1. A sports boot comprising:

a shell base including a pair of laterally opposed flanks extending upwardly to respective portions of the shell base to an area corresponding to a wearer's ankle, said shell base further including a frontal portion having an upper longitudinally extending opening;

an upper attached to said shell base and overlapping said flanks of said shell base;

said frontal portion of said shell base further including a pair of transverse flaps, said transverse flaps overlapping and closing said longitudinally extending opening;

each of said transverse flaps is at least partially separated from a respective one of said flanks by a respective slit opening upwardly and oriented substantially parallel to said upper longitudinally extending opening of said shell base;

said shell base further including a pair of tongues extending upwardly from respective ones of said transverse flaps;

said shell base further including sliding connections, each sliding connection slidably connecting one of said tongues to a respective one of said opposed flanks.

2. A sports boot according to claim 1, wherein:

each of said tongues and a respective flank are permanently connected by means of said sliding connection during longitudinal movement of said tongue between an initial position and an extreme forward position whereby said tongue is separated from the instep zone.

3. A sports boot according to claim 1, wherein:

said tongues are unitary with respective ones of said transverse flaps.

4. A sports boot according to claim 1, wherein:

said tongues have lower ends extending continuously from rearward ends of respective ones of said transverse flaps in an instep zone of said shell base.

5. A sports boot comprising:

a shell base and an upper, the upper affixed to and extending upwardly from said shell base;

said shell base comprising:

a rear portion adapted to encircle an ankle of a wearer up to an instep zone, said rear portion having a pair of flanks positioned on laterally opposed sides of the shell base;

a frontal portion adapted to extend transversely around a front foot area of the wearer;

said frontal portion of the shell base having a slit and a pair of transverse flaps enclosing said slit, said transverse flaps extending transversely from respective opposed sides of said frontal portion the shell base, at least one of said flaps having a tongue longitudinally extending independently of said flanks of said rear portion of the shell base, said tongue being located at least at said instep zone and extending beneath said upper, said tongue being movable longitudinally with respect to said flanks and with respect to the instep zone at least during insertion or removal of the wearer's foot from the shell base;

a sliding connection between said tongue and one of said flanks of said rear portion of said shell base, said tongue and said one of said flanks being on a common side of the shell base, said tongue and said one of said flanks being permanently connected by means of said sliding connection during longitudinal movement of said tongue between an initial position and an extreme forward position whereby said tongue is separated from the instep zone.

6. A sports boot according to claim 5, wherein:

said tongue is unitary with said one of said flanks.

7. A sports boot according to claim 5, wherein:

each of said flaps has a tongue longitudinally extending independently of said flanks of said rear portion of the shell base, each of said tongues being located at least at said instep zone and extending beneath said upper, each of said tongues being movable longitudinally with respect to said flanks and with respect to the instep zone at least during insertion or removal of the wearer's foot from the shell base;

a sliding connection is provided between each of said tongues and respective contiguous ones of said flanks of said rear portion of said shell base, both of said tongues said respective flanks being permanently connected by means of respective sliding connections during longitudinal movement of said tongues between initial positions and extreme forward positions whereby said tongues are separated from the instep zone.

8. A sports boot according to claim 5, wherein:

said sliding connection comprises a cut-out in said one of said flanks and a laterally extending tab provided on said tongue, said tab having an end extending freely slidable through said cut-out.

9. A sports boot according to claim 8, wherein:

said tab has a length in correlation with a separation amplitude corresponding to said extreme forward position of said tongue, whereby said tab remains engaged in said cut-out at said extreme forward position of said tongue.

10. A sports boot according to claim 8, wherein:

said tab has, at said end, at least one gripping projection constituting a retention abutment for opposing removal of said tab from said cut-out.

11. A sports boot according to claim 5, wherein:

said sliding connection comprises an elongated closed slot in said one of said flanks and an element connecting said tongue and said one of said flanks, said element sliding freely within said elongated slot.

12. A sports boot according to claim 11, wherein:

said elongated slot has a length in correlation with a separation amplitude corresponding to said extreme forward position of said tongue.

13. A sports boot according to claim 5, wherein:

said tongue is made of a relatively flexible material, said tongue being attached to and at least partially covering said at least one of said flaps.

14. A sports boot according to claim 5, wherein:

at least in said initial position of said tongue, said tongue overlaps over said one of said flanks.

15. A sports boot according to claim 14, wherein:

said tongue remains permanently overlapped over said one of said flanks in said extreme forward position of said tongue.

16. A sports boot according to claim 5, wherein:

at least in said initial position of said tongue, said tongue overlaps under said one of said flanks.

17. A sports boot comprising:

a shell base having a pair of opposed lateral flanks, said lateral flanks extending upwardly to an area corresponding to a wearer's ankle;

an upper attached to said shell base and overlapping said lateral flanks of said shell base;

said shell base having a frontal portion, said frontal portion including an upper longitudinally extending opening;

said frontal portion of said shell base further including a pair of transversely extending flaps, said flaps overlapping said longitudinally extending opening of said shell base, said flaps having front ends at a front end of said longitudinally extending opening;

each of said transversely extending flaps is extended rearwardly by a respective tongue of said shell base, each of said transverse flaps and a respective one of said tongues having a continuous common edge, each of said common edges extending from said front portion of said shell base, continuously longitudinally through an instep zone of said shell base;

said shell base further including sliding connections, each sliding connection slidably connecting one of said tongues to a respective one of said opposed flanks.

18. A sports boot according to claim 17, wherein:

each of said tongues and a respective flank are permanently connected by means of said sliding connection during longitudinal movement of said tongue between an initial position and an extreme forward position whereby said tongue is separated from the instep zone.

19. A sports boot according to claim 17, wherein:

said tongues are unitary with respective ones of said transverse flaps.

20. A sports boot according to claim 17, wherein:

said transversely extending flaps are in an overlapping relationship and said tongues are in an overlapping relationship.

* * * * *